US006906462B1

(12) United States Patent
Gorille

(10) Patent No.: US 6,906,462 B1
(45) Date of Patent: Jun. 14, 2005

(54) GAS DISCHARGE LAMP WITH IGNITION ASSISTING ELECTRODES, ESPECIALLY FOR AUTOMOBILE HEADLIGHTS

(75) Inventor: Ingo Gorille, Oberriexingen (DE)

(73) Assignee: Robert Bosch GmbH, Struttgart (DE)

( * ) Notice: Subject to any disclaimer, the term of this patent is extended or adjusted under 35 U.S.C. 154(b) by 0 days.

(21) Appl. No.: 09/979,729

(22) PCT Filed: May 28, 2000

(86) PCT No.: PCT/DE00/00910

§ 371 (c)(1),
(2), (4) Date: Mar. 12, 2002

(87) PCT Pub. No.: WO01/73817

PCT Pub. Date: Oct. 4, 2001

(51) Int. Cl.[7] ..... H01J 65/00
(52) U.S. Cl. ..... 313/607; 313/594; 313/595
(58) Field of Search ..... 313/607, 631, 313/634, 635, 244, 283, 284, 285, 286, 291, 574, 594–595

(56) References Cited

U.S. PATENT DOCUMENTS

| | | | | |
|---|---|---|---|---|
| 1,951,112 A | | 3/1934 | Wels | |
| 4,223,247 A | | 9/1980 | Jacobs | |
| 4,316,122 A | * | 2/1982 | Yamazaki et al. | 315/74 |
| 4,539,513 A | | 9/1985 | Ganser | |
| 4,734,612 A | * | 3/1988 | Sasaki et al. | 313/15 |
| 5,391,960 A | * | 2/1995 | Moribayashi et al. | 313/594 |
| 5,446,336 A | * | 8/1995 | Gleixner et al. | 313/25 |
| 5,541,480 A | * | 7/1996 | Renardus et al. | 313/635 |
| 5,668,440 A | * | 9/1997 | Inukai et al. | 313/635 |
| 5,925,988 A | | 7/1999 | Grave | |
| 5,965,988 A | * | 10/1999 | Vollkommer et al. | 315/246 |
| 5,990,633 A | * | 11/1999 | Hirschmann et al. | 315/289 |
| 6,445,129 B1 | * | 9/2002 | Seiler et al. | 313/594 |
| 6,515,413 B1 | * | 2/2003 | New et al. | 313/493 |

FOREIGN PATENT DOCUMENTS

| | | |
|---|---|---|
| DE | 29 48 996 A | 6/1981 |
| DE | 196 24 243 A | 1/1998 |
| EP | 0 477 621 A | 4/1992 |

OTHER PUBLICATIONS

Patent Abstracts of Japan, vol. 015, No. 323 (E–1101), Aug. 16, 1991 & JP 03 119696 A (Stanley Electric Co Ltd), May 22, 1991.

* cited by examiner

*Primary Examiner*—Edward J. Glick
*Assistant Examiner*—Elizabeth Keaney
(74) *Attorney, Agent, or Firm*—Ronald E. Greigg

(57) ABSTRACT

The gas discharge lamp has a burner, which has a discharge vessel with a void, in which a filling of gas and other substances is disposed. Two electrodes protrude into the void, and between them, in operation of the gas discharge lamp, an electric arc develops. On the outside of the discharge vessel, in the region of the void, two auxiliary electrodes of opposite polarity are disposed facing one another. The auxiliary electrodes are formed by coating the outside of the discharge vessel with electrically conductive material. Prior to and optionally also during the ignition of the gas discharge lamp, high-frequency high voltage is applied to the auxiliary electrodes, which facilitates the ignition of the gas discharge lamp.

2 Claims, 2 Drawing Sheets

GAS DISCHARGE LAMP WITH IGNITION ASSISTING ELECTRODES, ESPECIALLY FOR AUTOMOBILE HEADLIGHTS

CROSS-REFERENCE TO RELATED APPLICATIONS

This application is a 35 USC 371 application of PCT/DE 00/00910 filed on Mar. 28, 2000.

BACKGROUND OF THE INVENTION

1. Field of the Invention

The invention is directed to gas discharge lamps, and more particularly to gas discharge lamps for motor vehicle headlights.

2. Brief Description of the Prior Art

One prior art gas discharge lamp is known from German Patent Disclosure DE 196 10 387 A1. This gas discharge lamp has a burner vessel, with a void into which two electrodes of opposed polarity protrude, between which an electric arc develops in operation. A filling of gas and solid substances is disposed in the void. Also disposed in the void is at least one auxiliary electrode, which serves to improve the ignition performance of the gas discharge lamp. The at least one auxiliary electrode is disposed in such a way that compared to the burning path between the two electrodes, a shorter ignition path is brought about, which facilitates the ignition of the gas discharge lamp. It can prove difficult to assure the requisite separation between the electrodes and the at least one auxiliary electrode and the separation of the burning path and the ignition path.

SUMMARY OF THE INVENTION

The gas discharge lamp of the invention has the advantage over the prior art that it is possible to dispose the at least one auxiliary electrode on the outside of the burner vessel in a simple manner. As a result of the high-frequency electrical voltage applied to both the auxiliary electrode and the counterelectrode, dielectrically hindered discharges, so-called silent discharges or barrier discharges, are generated in the void of the burner vessel. As a result, the gas in the filling of the void is energetically excited. Upon ignition of the gas discharge lamp by the application of high voltage to the electrodes, the electrical breakdown through the gas of the filling in the void takes place faster and/or sooner, at a lower voltage, than would be the case without the auxiliary electrode.

BRIEF DESCRIPTION OF THE DRAWINGS

Other features and advantages of the invention will become apparent from the detailed description contained below, taken in conjunction with the drawing, in which.

DESCRIPTION OF THE PREFERRED EMBODIMENTS

Figure 1:
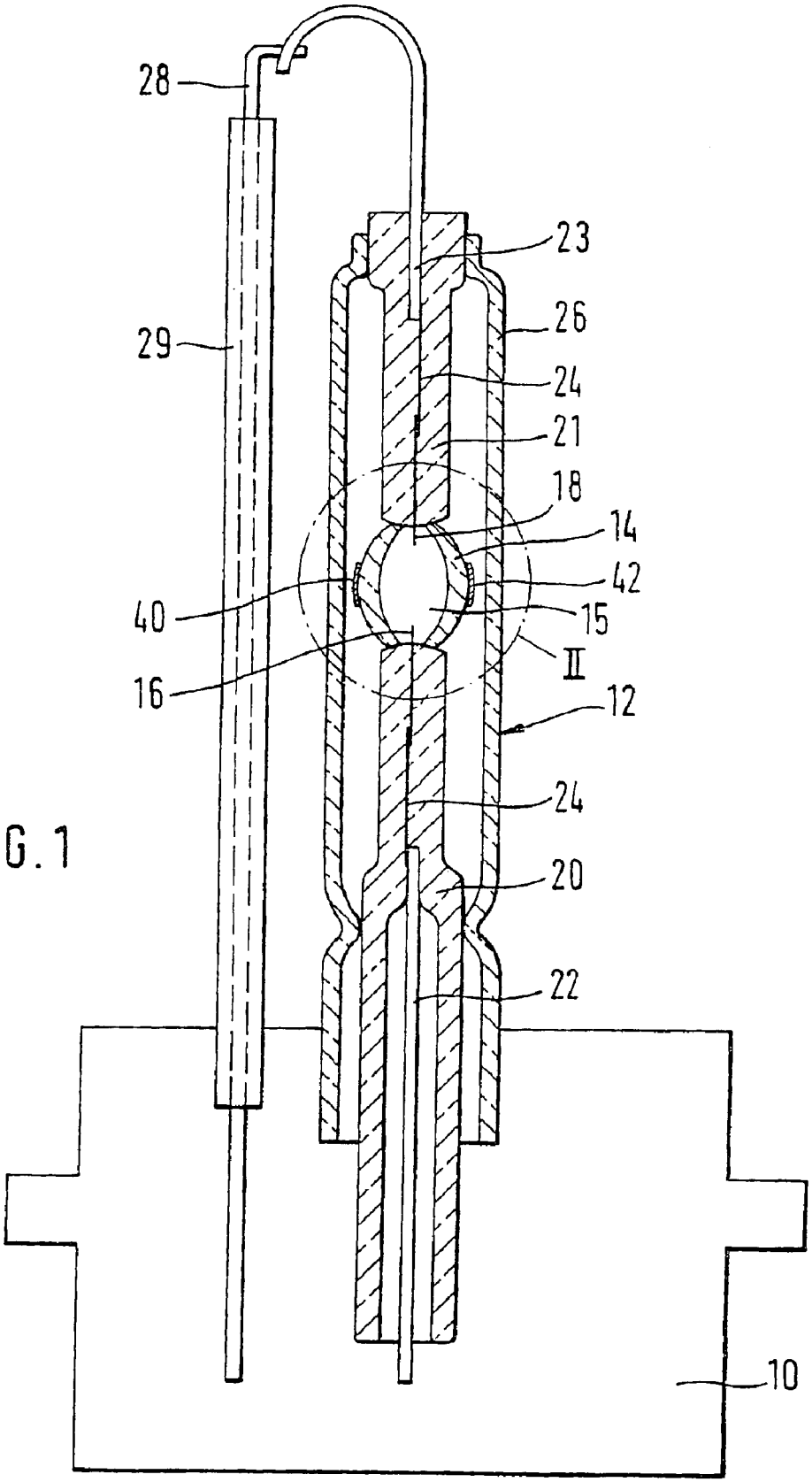
FIG. 1 shows a gas discharge lamp in a longitudinal section.
Figure 3:
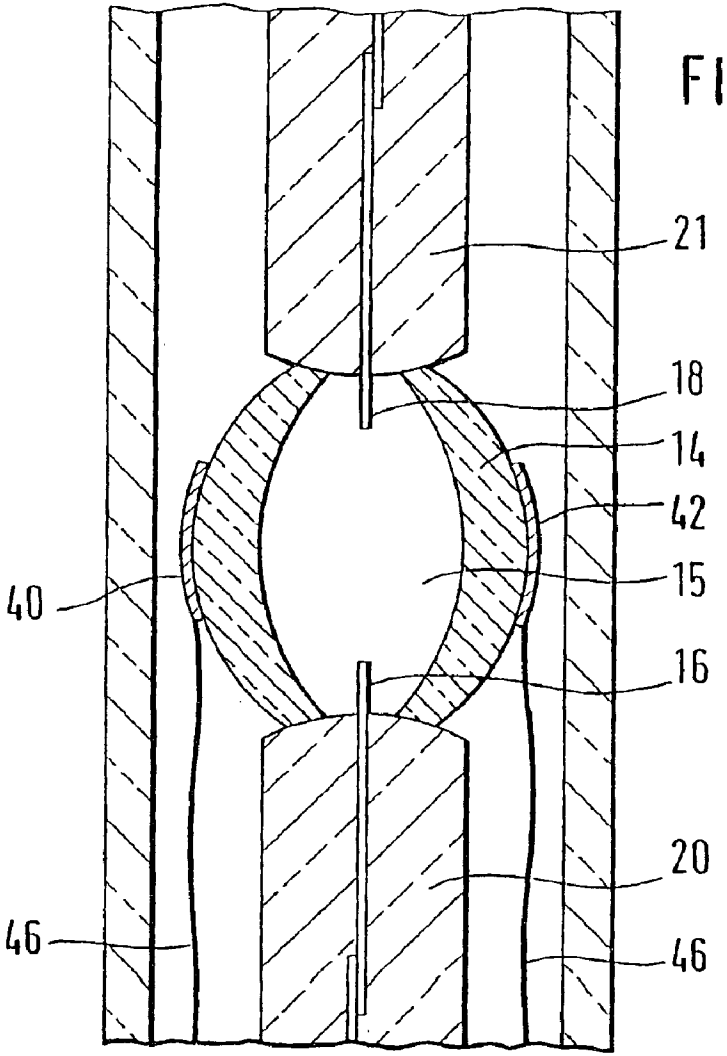
FIG. 3 shows the detail II of the gas discharge lamp in a second exemplary embodiment.
Figure 2:
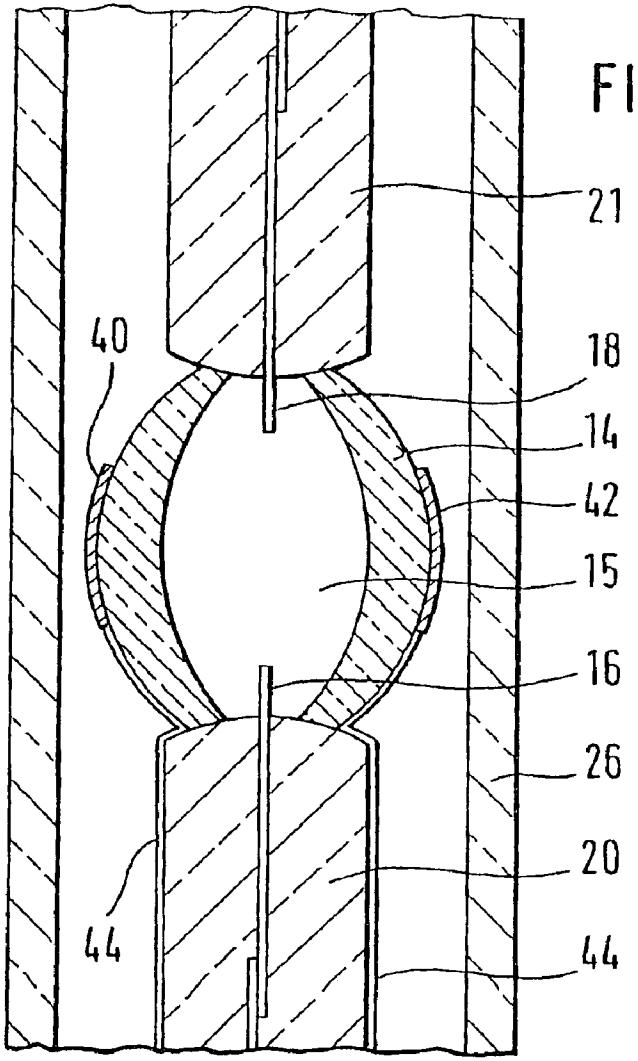
FIG. 2 shows a detail, marked II in FIG. 1, of the gas discharge lamp of a first exemplary embodiment on a larger scale.

A gas discharge lamp shown in FIGS. 1–3 is intended in particular for use in vehicle lighting devices, such as headlights. The gas discharge lamp has a base 10, shown highly simplified, which can be embodied in multiple parts and by way of which it can for instance be disposed in an opening in a reflector of the headlight. A burner 12, which has a discharge vessel 14, is connected to the base 10. The discharge vessel 14 has a void 15, into which at least two electrodes 16, 18 protrude and which contains a filling that comprises a noble gas, preferably xenon, and mercury, and optionally metal halides as well. The discharge vessel 14 has tubular extensions 20, 21, adjoining the void 15; a lead line 22 to the electrode 16 is disposed in the extension 20 toward the base 10, and a line 23 connected to the other electrode 18 is disposed in the extension 21 remote from the base 10. The discharge vessel 14 with the extensions 20, 21 is of glass, preferably quartz glass. A metal fuel 24 which preferably comprises molybdenum connects lines 22, 23 to the electrodes 16, 18, respectively. The burner 12 can moreover have a glass tube 26, at least partly surrounding the discharge vessel 14 with its extensions 21, 21, and this tube can serve on the one hand to protect the discharge vessel 14 and on the other to shield against UV radiation occurring in operation of the gas discharge lamp. A return line 28 extending outside the burner 12 is connected to the line 23 and leads along the burner 12 to the base 10; it can be provided with an insulator 29. The lead line 22 to the electrode 16 and the return line 23 from the electrode 18 are each connected to the base with a respective plug contact, not shown.

For the operation of the gas discharge lamp, an electrical choke device is provided, which has an ignition part and a control part. The ignition part can be disposed separately from the gas discharge lamp, or it can be integrated with the base 10 thereof. The ignition part serves to ignite the gas discharge lamp, and it generates high voltage, which is applied to the electrodes 16, 18 in order to bring about a breakdown between them. Depending on the state of the gas discharge lamp, especially in the warm state, a very high voltage is required to ignite the gas discharge lamp. As an example, the ignition part can be constructed on the principle of resonance ignition. In operation of the gas discharge lamp, an electric arc develops between the electrodes 16, 18 in the void 15 of the discharge vessel 14.

In a first embodiment of the invention, at least two auxiliary electrodes 40, 42 are provided, which are disposed outside the discharge vessel 14 in the region of its void 15.

In FIG. 2, the auxiliary electrodes 40, 42 are shown in accordance with a first exemplary embodiment, in which they are formed by an electrically conductive coating of the outside of the discharge vessel 14 in the region of the void 15. The coating for forming the auxiliary electrodes 40, 42 can for instance comprise a metal with adequate heat resistance and can be applied to the discharge vessel 14 by vapor deposition, painting, or in some other suitable way.

The two auxiliary electrodes 40, 42 are disposed, at least approximately diametrically opposite one another, on the discharge vessel 14. It is also possible for more than two auxiliary electrodes 40, 42 to be provided; then for instance each two auxiliary electrodes are disposed facing one another. The coatings that form the two auxiliary electrodes 40, 42 are separate from one another, and each extends over part of the circumference of the discharge vessel 14 around the void 15. A respective conductor track 44 extending along the discharge vessel 14 can be connected to the auxiliary electrodes 40, 42, and these tracks lead to the base 10 of the gas discharge lamp. Alternatively, the auxiliary electrodes 40, 42 can be contacted in an arbitrary other way, such as by means of cables connected to them. By means of the electrical choke device, such as its ignition part, a high-frequency high voltage is applied to the auxiliary electrodes 40, 42, and the two auxiliary electrodes 40, 42 have opposite polarity from one another. It can be provided that the auxiliary electrodes 40, 42 are supplied with high-frequency high voltage for only a predetermined period of time prior to and optionally during the ignition of the gas discharge lamp, or alternatively, it can be provided that the auxiliary electrodes 40, 42 are supplied with high-frequency high voltage constantly while the gas discharge lamp is off. The high voltage can amount to more than 1 kV, and the frequency can amount to more than 10 kHz.

If the auxiliary electrodes 40, 42 are supplied with high-frequency high voltage, dielectrically hindered discharges, so-called silent discharges or barrier discharges, are generated in the void 15 of the discharge vessel 14 of the gas discharge lamp. As a result, the filing of the void 15, and in particular the noble gas, is energetically excited. Upon ignition of the gas discharge lamp by means of the ignition part of the choke device by the application of high voltage to the electrodes 16, 18, the dielectrical breakdown through the noble gas in the void 15 between the electrodes 16, 18 takes place faster and/or at a lower ignition voltage than would be the case without the auxiliary electrodes 40, 42. The ignition part of the choke device can thus be designed as correspondingly weaker, which has cost advantages. The gas discharge lamp can also be embodied more simply in its overall design in terms of insulation provisions, since only lesser ignition voltages are required. Furthermore, the gas discharge lamp can attain a longer service life because of the reduced ignition load.

The auxiliary electrodes 40, 42 are disposed between the outside of the discharge vessel 14 and the glass tube 26, so that the electrodes cannot be touched, and no risk emanates from them. As an alternative to the embodiment described above, the auxiliary electrodes 40, 42 can also be formed by a conductive coating of the inside of the glass tube 26, in the region of the glass tube 26 surrounding the void 15 of the discharge vessel 14. Then the contacting of the auxiliary electrodes 40, 42 can again be done via conductor tracks on the inside of the glass tube 26, or in some arbitrary other way.

In FIG. 3, the gas discharge lamp is shown in fragments in accordance with a second exemplary embodiment. The fundamental construction of the gas discharge lamp is the same as in the first exemplary embodiment, but the embodiment of the auxiliary electrodes is modified. The auxiliary electrodes 40, 42 in the second exemplary embodiment are disposed as separate parts on the outside of the discharge vessel 14, in the region of its void 15. The auxiliary electrodes 40, 42 comprise electrically conductive material, especially metal, and can be adapted in their shape to the outside of the discharge vessel 14 in the region of the void 15, or in other words can for instance be embodied in curved fashion. The auxiliary electrodes 40, 42 can be connected to the discharge vessel 14 by means of a clamp or detent connection, by adhesive bonding, or in some arbitrary other way. The auxiliary electrodes 40, 42 can also be clamped in place between the discharge vessel 14 and the glass tube 26. Connected to the auxiliary electrodes 40, 42 are electric lines 46 that lead to the base 10 of the gas discharge lamp and serve to connect the auxiliary electrodes 40, 42 to the high-frequency high voltage, as in the first exemplary embodiment.

In another embodiment of the invention, only one of the auxiliary electrodes 40, 42, which can be embodied as described above, is provided on the outside of the discharge vessel 14. Acting as the counterelectrode to this one auxiliary electrode 40 or 42 is one of the electrodes 16, 18 protruding into the void 15. As in the first embodiment, a high-frequency high voltage of opposite polarity is applied to the auxiliary electrode 40 or 42 and to the counterelectrode 16 or 18, so that between the auxiliary electrode 40 or 42 and the counterelectrode 16 or 18, an electrical field develops, which penetrates the void 15 and facilitates the ignition of the gas discharge lamp.

The foregoing relates to preferred exemplary embodiments of the invention, it being understood that other variants and embodiments thereof are possible within the spirit and scope of the invention, the latter being defined by the appended claims.

I claim:

1. A gas discharge lamp, especially for headlights for vehicles, comprising a burner (12) including a discharge vessel (14) with a void (15), in which a filling of gas and other substances is disposed and into which at least two main electrodes (16,18) protrude, between which electrodes an electric arc forms in operation of the gas discharge lamp, and having at least one auxiliary electrode to improve the ignition performance of the gas discharge lamp, said at least one auxiliary electrode being disposed on the outside of the discharge vessel (14) in the region of the void (15), and at least one counterelectrode, and means for applying a high-frequency electrical voltage to said at least one auxiliary electrode and to said at least one counterelectrode at least prior to and/or during the ignition of the gas discharge lamp wherein said discharge vessel (14) is at least partly surrounded by a guard tube (26), and wherein the at least one auxiliary electrode is disposed between the outside of the discharge vessel (14) and the guard tube (26), said means for applying high-frequency electrical voltage to said at least one auxiliary electrode and to said at least one counterelectrode being controlled such that it does not generate an arc between said auxiliary electrode and said at least one counterelectrode.

2. A gas discharge lamp, especially for headlights for vehicles, comprising a burner (12) including a discharge vessel (14) with a void (15), in which a filling of gas and other substances is disposed and into which at least two main electrodes (16, 18) protrude, between which electrodes an electric arc forms in operation of the gas discharge lamp, and having at least one auxiliary electrode to improve the ignition performance of the gas discharge lamp, said at least one auxiliary electrode being disposed on the outside of the discharge vessel (14) in the region of the void (15), and at least one counterelectrode, and means for applying a high-frequency electrical voltage to said at least one auxiliary electrode and to said at least one counterelectrode at least prior to and/or during the ignition of the gas discharge lamp wherein said discharge vessel (14) is at least partly surrounded by a guard tube (26), and wherein the at least one auxiliary electrode is disposed between the outside of the discharge vessel (14) and the guard tube (26), said means for applying high-frequency electrical voltage to said at least one auxiliary electrode and to said at least one counterelectrode being controlled such that it does not generate an arc between said auxiliary electrode and said at least one counterelectrode, wherein said the at least one auxiliary electrode is formed by coating the outside of the discharge vessel (14) with electrically conductive material, and wherein the at least one auxiliary electrode comprises two auxiliary electrodes disposed, facing one another, on the discharge vessel (14).

* * * * *

UNITED STATES PATENT AND TRADEMARK OFFICE

CERTIFICATE OF CORRECTION

PATENT NO. : 6,906,462 B1
DATED : June 14, 2005
INVENTOR(S) : Ingo Gorille

It is certified that error appears in the above-identified patent and that said Letters Patent is hereby corrected as shown below:

Title page,
Item [73], should read as follows:
-- [73] Assignee: Robert Bosch GmbH, Stuttgart (DE) --

Signed and Sealed this

Ninth Day of August, 2005

JON W. DUDAS
*Director of the United States Patent and Trademark Office*